US010586637B2

(12) United States Patent
Maezawa et al.

(10) Patent No.: US 10,586,637 B2
(45) Date of Patent: Mar. 10, 2020

(54) SOFT MAGNETIC FLATTENED POWDER AND METHOD FOR PRODUCING THE SAME

(71) Applicant: Sanyo Special Steel Co., Ltd., Himeji-shi (JP)

(72) Inventors: Fumihiro Maezawa, Himeji (JP); Toshiyuki Sawada, Himeji (JP)

(73) Assignee: Sanyo Special Steel Co., Ltd., Hyogo (JP)

( * ) Notice: Subject to any disclaimer, the term of this patent is extended or adjusted under 35 U.S.C. 154(b) by 265 days.

(21) Appl. No.: 15/516,230

(22) PCT Filed: Sep. 29, 2015

(86) PCT No.: PCT/JP2015/077504
§ 371 (c)(1),
(2) Date: Mar. 31, 2017

(87) PCT Pub. No.: WO2016/052498
PCT Pub. Date: Apr. 7, 2016

(65) Prior Publication Data

US 2017/0301442 A1 Oct. 19, 2017

(30) Foreign Application Priority Data

Oct. 2, 2014 (JP) ..... 2014-203642

(51) Int. Cl.

| | |
|---|---|
| ***H01F 1/147*** | (2006.01) |
| ***B22F 9/10*** | (2006.01) |
| ***B22F 1/00*** | (2006.01) |
| ***B22F 9/08*** | (2006.01) |
| ***C21D 1/773*** | (2006.01) |
| ***C21D 6/00*** | (2006.01) |
| ***C22C 38/02*** | (2006.01) |
| ***C22C 38/06*** | (2006.01) |
| *C22C 38/00* | (2006.01) |

(52) U.S. Cl.
CPC ..... *H01F 1/14791* (2013.01); *B22F 1/0011* (2013.01); *B22F 1/0055* (2013.01); *B22F 1/0085* (2013.01); *B22F 9/082* (2013.01); *B22F 9/10* (2013.01); *C21D 1/773* (2013.01); *C21D 6/008* (2013.01); *C22C 38/02* (2013.01); *C22C 38/06* (2013.01); *B22F 2201/11* (2013.01); *B22F 2201/20* (2013.01); *B22F 2301/35* (2013.01); *B22F 2304/10* (2013.01); *B22F 2999/00* (2013.01); *C22C 38/00* (2013.01); *C22C 2202/02* (2013.01)

(58) Field of Classification Search
None
See application file for complete search history.

(56) References Cited

U.S. PATENT DOCUMENTS

| | | | | |
|---|---|---|---|---|
| 7,455,905 | B2 * | 11/2008 | Ye | B22F 1/02 427/127 |
| 8,123,972 | B2 | 2/2012 | Aramaki et al. | |
| 8,864,929 | B2 * | 10/2014 | Aramaki | B22F 1/0055 156/246 |
| 9,190,195 | B2 | 11/2015 | Kino | |
| 2007/0196671 | A1 * | 8/2007 | Kobayashi | B82Y 25/00 428/447 |
| 2009/0267017 | A1 * | 10/2009 | Matsukawa | B22F 1/0055 252/62.55 |
| 2010/0001226 | A1 * | 1/2010 | Aramaki | B22F 3/22 252/62.55 |
| 2016/0211061 | A1 * | 7/2016 | Masuda | H05K 3/285 |
| 2016/0276078 | A1 * | 9/2016 | Pagano | H01F 1/26 |
| 2017/0117081 | A1 * | 4/2017 | Chatani | B22F 3/11 |

FOREIGN PATENT DOCUMENTS

| | | | |
|---|---|---|---|
| CN | 101536121 | A | 9/2009 |
| CN | 101536125 | A | 9/2009 |
| JP | 2003105403 | A | 4/2003 |
| JP | 2003332113 | A | 11/2003 |
| JP | 2008135713 | A | 6/2008 |
| JP | 4636113 | B2 | 2/2011 |
| JP | 201122661 | A | 2/2011 |
| TW | 201230084 | A1 | 7/2012 |

OTHER PUBLICATIONS

Machine Translation of JP 2003-332113 A (Year: 2003).*
Japanese Office Action dated Jul. 10, 2018 for Application No. 2014-203642, with a machine translation in English.
Japanese Office Action dated Feb. 5, 2019 for Application No. 2014-203642, with a machine translation in English.

* cited by examiner

*Primary Examiner* — Kevin M Bernatz
(74) *Attorney, Agent, or Firm* — The Webb Law Firm

(57) ABSTRACT

In accordance with the present invention, there are provided: a soft magnetic flattened powder having an average particle diameter, excellent sheet moldability, and a high magnetic permeability; and a method for producing the soft magnetic flattened powder. The soft magnetic flattened powder according to the present invention includes an Fe—Si—Al-based alloy, an average particle diameter $D_{50}$ being 30 to less than 50 μm; a coercive force Hc measured by applying a magnetic field in the longitudinal direction of the flattened powder being 176 A/m or less; the ratio of a tap density to a true density being 0.18 or less; a specific surface area BET value being 0.6 $m^2/g$ or more; the amount of contained oxygen being 0.6 mass % or less; and the BET value and oxygen value of the soft magnetic powder satisfying expression (1): [oxygen value/BET value≤0.50 $mg \cdot g/m^2$ (excluding zero)].

2 Claims, No Drawings

SOFT MAGNETIC FLATTENED POWDER AND METHOD FOR PRODUCING THE SAME

CROSS-REFERENCE TO RELATED APPLICATIONS

This application is the United States national phase of International Application No. PCT/JP2015/0077504 filed Sep. 29, 2015, and claims priority to Japanese Patent Application No. 2014-203642 filed Oct. 2, 2014, the disclosures of which are hereby incorporated in their entirety by reference.

BACKGROUND OF THE INVENTION

Field of the Invention

The present invention relates to a soft magnetic flattened powder used in a magnetic sheet for suppressing noise, and relates to a method for producing the soft magnetic flattened powder.

Background Art

Conventionally, magnetic sheets containing soft magnetic flattened powders have been used as electromagnetic wave absorbers and antennas for RFID (RadioFrequency Identification). In recent years, such magnetic sheets have also been used in position detection apparatuses referred to as digitizers. Examples of the digitizers include an electromagnetic induction type digitizer such as described in Japanese Patent Laid-Open No. 2011-22661 (PLT 1). The digitizer detects an indicated position by reading a high-frequency signal transmitted from a coil included in a tip of a position indicator having a pen shape, with a loop coil included in a position detector having a panel shape.

For the purpose of enhancing detection sensitivity, a sheet which becomes a magnetic path for the high-frequency signal is arranged on the back face of the loop coil. A magnetic sheet in which a soft magnetic flattened powder is oriented in resin or rubber, laminated soft magnetic amorphous alloy foil, or the like is applied as the sheet which becomes the magnetic path. The use of the magnetic sheet enables the entire detection panel to be made as a single sheet, and therefore prevents poor detection in a laminated portion such as the amorphous foil, and the like from occurring, thereby resulting in excellent uniformity.

Conventionally, powders comprising an Fe—Si—Al alloy, an Fe—Si alloy, an Fe—Ni alloy, an Fe—Al alloy, an Fe—Cr alloy, or the like, flattened by an attrition mill (attritor) or the like, have been added to magnetic sheets. This is because it is important to use a soft magnetic powder having a high magnetic permeability, as is clear from so-called "Ollendorff's formula", to use a flattened powder having a high aspect ratio in a magnetization direction to decrease a demagnetizing field, and to highly fill a soft magnetic powder into a magnetic sheet, for obtaining a magnetic sheet having a high magnetic permeability. For example, Japanese Patent No. 4636113 (PLT 2) discloses a method of performing flattening-processing by using a monohydric alcohol having 2 to 4 carbon atoms, as a method of producing a flat-shaped powder having a high aspect ratio by increasing the major diameter of a soft magnetic flattened powder.

Digitizer functions are applied to smartphones, tablet terminals, and the like. However, the need for downsizing such mobile electronic devices has intensified, the need for thinning magnetic sheets used as magnetic path sheets has also increased, and magnetic sheets having a thickness of around 50 μm or less have been used. In addition, some tablet terminals have had liquid crystal display screens of as much as 10 inches, and magnetic sheets having large areas have also been required. The sheet moldability of a powder, which has not been problematic in magnetic sheets having conventional thicknesses, has become problematic in the case of producing such a thin magnetic sheet by a commonly applied method with rolling or pressing.

In other words, in production of a magnetic sheet having a thickness of 50 μm or less, the excessive major diameter of a soft magnetic flattened powder used often results in failed molding of the sheet due to nonuniform directionality and to coarseness and minuteness in the magnetic powder in the sheet. In order to eliminate such troubles in the molding of the sheet, a method of decreasing a powder filling rate in the production of the sheet, a method of pressing the sheet after the molding, or the like is carried out. However, the former method or the like results in decrease in the magnetic permeability of the sheet, thereby deteriorating performance. The latter method or the like results in application of excessive stress to the powder in the sheet, and therefore, distortion is introduced into the powder. The introduction of the distortion causes the coercive force Hc of the powder to be increased and the magnetic permeability of the powder to be decreased, and therefore results in deterioration of performance.

CITATION LIST

Patent Literature

[PLT 1] Japanese Patent Laid-Open No. 2011-22661
[PLT 2] Japanese Patent No. 4636113

SUMMARY OF THE INVENTION

For example, when a soft magnetic flattened powder having a large average particle diameter $D_{50}$, as described in Patent Literature 2, is used, sheet molding is difficult.

Thus, an object of the present invention is to provide: a soft magnetic flattened powder which has a small average particle diameter, is excellent in the moldability of a thin magnetic sheet of 50 μm or less, and moreover has a high magnetic permeability; and a method for producing the soft magnetic flattened powder.

According to an embodiment of the present invention, there is provided a soft magnetic flattened powder which is a flattened powder comprising an Fe—Si—Al-based alloy, an average particle diameter $D_{50}$ being 30 to less than 50 μm;

a coercive force Hc measured by applying a magnetic field in the longitudinal direction of the flattened powder being 176 A/m or less;

the ratio of a tap density to a true density being 0.18 or less;

a specific surface area BET value being 0.6 $m^2/g$ or more;

the amount of contained oxygen being 0.6 mass % or less; and the BET value and oxygen value of the soft magnetic powder satisfying the following expression (1):

$$\text{oxygen value/BET value} \leq 0.50 \text{ mass \%} \cdot g/m^2 \text{ (excluding zero)} \quad (1).$$

According to another embodiment of the present invention, there is provided a method for producing the soft magnetic flattened powder described above comprising:

a raw material production step of producing a raw powder by a gas atomization method or a disk atomization method;

a flattening-processing step of flattening the raw powder; and a step of heat-treating the flattening-processed raw powder in a vacuum or argon atmosphere at 700 to 900° C.

A magnetic sheet for an electromagnetic wave absorber having a sufficiently high magnetic permeability can be produced by using the soft magnetic flattened powder that satisfies the above-described conditions. A magnetic permeability μ in high frequencies can be represented by a complex magnetic permeability ($\mu=\mu'-j\mu''$) with a real part μ' and an imaginary part μ", and the value of μ" tends to increase with increasing the maximum value of μ.

The soft magnetic flattened powder of the present invention preferably has an aspect ratio of 20 or more, and an average particle diameter of 30 to less than 50 μm, and preferably 40 to less than 50 μm. An average particle diameter of less than 30 μm is not preferred because of resulting in difficulty in securing a high aspect ratio. An average particle diameter of 50 μm or more is not preferred because of deterioration of sheet moldability. The production of the soft magnetic flattened powder under the conditions described above enables the production of the powder having favorable sheet moldability and a high magnetic permeability.

The present invention is to provide a method for producing the soft magnetic flattened powder described above comprising: a flattening-processing step of flattening a soft magnetic alloy powder produced by an atomization method; and a heat treatment step of performing heat treatment under a vacuum atmosphere or in an inert gas.

DETAILED DESCRIPTION OF THE INVENTION

The present invention will be described in detail below. A soft magnetic flattened powder according to the present invention is produced by a production method comprising a raw powder production step, a flattening-processing step, and a heat treatment step. Each step will be described below.

[Raw Powder Production Step]

The soft magnetic flattened powder according to the present invention can be produced by performing flattening treatment of a soft magnetic alloy powder. The soft magnetic alloy powder is preferably a powder having a low coercive force value, and more preferably a powder having a high saturation magnetization value. Commonly, an Fe—Si—Al-based alloy has an excellent coercive force value and an excellent saturation magnetization value.

The soft magnetic alloy powder is produced by various atomization methods such as a gas atomization method and a water atomization method. Because the amount of oxygen contained in the soft magnetic alloy powder is more preferably smaller, the production by the gas atomization method is preferred, and the production using an inert gas is still more preferred. Although the production is also enabled without any problem by a method with a disk atomization method, the gas atomization method is superior from the viewpoint of mass productivity.

The particle size of the soft magnetic alloy powder used in the present invention is not particularly limited, but the soft magnetic alloy powder may be classified depending on the purpose of adjusting an average particle diameter after flattening processing or the purpose of removing a powder having a large amount of contained oxygen, and in addition, the purpose of production.

[Flattening-Processing Step]

Then, the above-described soft magnetic alloy powder is flattened. A flattening-processing method, which is not particularly restricted, can be performed using, for example, an attritor, a ball mill, a vibration mill, or the like. Especially, it is preferable to use the attritor having a relatively excellent flattening-processing ability. It is preferable to use an inert gas when the processing is performed in a dry process. It is preferable to use an organic solvent when the processing is performed in a wet process. The kind of the organic solvent is not particularly limited.

The amount of the added organic solvent is preferably 100 parts by mass or more, and more preferably 200 parts by mass or more, with respect to 100 parts by mass of the soft magnetic alloy powder. The upper limit of the amount of the added organic solvent is not particularly limited, but can be adjusted as appropriate depending on a balance between the size/shape of a demanded flat powder and productivity. It is preferable to perform processing so that the concentration of water in the organic solvent is 0.002 part by mass or less with respect to 100 parts by mass of the organic solvent in order to reduce an oxygen content. A flattening auxiliary may be used together with the organic solvent, and 5 parts by mass or less of the flattening auxiliary with respect to 100 parts by mass of the soft magnetic alloy powder is preferred for suppressing oxidation.

[Heat Treatment Step]

Then, the above-described soft magnetic flattened powder is heat-treated. A heat treatment apparatus is not particularly restricted, but it is preferable to perform the heat treatment under a condition of a heat treatment temperature of 700° C. to 900° C. The heat treatment at the temperature causes a coercive force to decrease, thereby resulting in the soft magnetic flattened powder having a high magnetic permeability. A heat treatment time, which is not particularly restricted, may be selected as appropriate depending on a treatment amount and productivity. Because the long-time heat treatment results in deterioration of productivity, the heat treatment time is preferably five hours or less.

The soft magnetic flattened powder used in the present invention is preferably heat-treated in a vacuum or in an inert gas (for example, argon gas) in order to suppress oxidation. The heat treatment in a nitrogen gas is also acceptable from the viewpoint of surface treatment; however, in such a case, a coercive force value tends to increase, and a magnetic permeability tends to decrease in comparison with a magnetic permeability in the case of the heat treatment in a vacuum.

The soft magnetic flattened powder according to the present invention comprises an Fe—Si—Al-based alloy, preferably consists essentially of the Fe—Si—Al-based alloy, and more preferably consists of the Fe—Si—Al-based alloy, and satisfies various physical properties described below.

[Average Particle Diameter $D_{50}$: 30 to Less than 50 μm]

The average particle diameter $D_{50}$ of the soft magnetic flattened powder is 30 to less than 50 μm, and preferably 40 to less than 50 μm. An average particle diameter of less than 30 μm tends to result in difficulty in obtaining the flattened powder having a high aspect ratio and to result in decrease in real part magnetic permeability μ'. Further, the excessively large average particle diameter is not preferred because of resulting in difficulty in sheet molding. Further, an average particle diameter of 50 μm or more tends to result in decrease in the resistivity of a sheet surface, causes special treatment to be needed for preventing the decrease, and is not preferred in view of performance and a cost.

[Coercive Force Hc: 176 A/m or Less]

A coercive force Hc measured by applying a magnetic field in the longitudinal direction of the soft magnetic flattened powder is 176 A/m or less, preferably 120 A/m or less, and still more preferably 100 A/m or less. In the scope of claims in the present invention, a magnetic permeability tends to increase with decreasing a coercive force value. Therefore, the lower limit of the coercive force is not particularly limited, but it is difficult to set the lower limit at 40 A/m or less in view of production conditions.

[Ratio of Tap Density to True Density: 0.18 or Less]

The ratio of the tap density to the true density of the soft magnetic flattened powder is 0.18 or less, and preferably 0.16 or less. The lower limit of the tap density is not particularly limited; however, the tap density tends to monotonously decrease with proceeding of processing, and long-time processing is not preferred because of resulting in decrease in average particle diameter and in increase in coercive force.

[Specific Surface Area BET Value: 0.6 $m^2/g$ or More]

The specific surface area BET value of the soft magnetic flattened powder of the present invention is 0.6 $m^2/g$ or more, preferably 0.8 $m^2/g$ or more, and still more preferably 1.0 $m^2/g$ or more. The upper limit of the specific surface area BET value of the soft magnetic flattened powder of the present invention is not particularly limited, but is preferably about 1.5 $m^2/g$ or less. Further, the aspect ratio of the soft magnetic flattened powder of the present invention (the ratio between the major diameter of the flattened powder and the minor diameter of the flattened powder) is preferably 20 or more. An aspect ratio of less than 20 results in increase in demagnetizing field and in decrease in apparent magnetic permeability.

[Concentration of Contained Oxygen: 0.6% or Less]

The concentration of oxygen contained in the soft magnetic flattened powder of the present invention is 0.6% or less, and preferably 0.3% or less. Existence forms of oxygen in the soft magnetic flattened powder can be considered to include two forms of grain boundary precipitation oxide and powder surface oxide, both of which are not preferred because of being able to be considered to cause a coercive force to be increased. The amount of grain boundary precipitation oxide can be reduced by suppressing oxidation in a step of producing a raw powder and a flattening-processing step. Further, the amount of powder surface oxide can be reduced by suppressing oxidation in a flattening-processing step and a heat treatment step. Herein, terms such as "concentration of contained oxygen", "amount of contained oxygen", and "oxygen value" are based only on differences in names, and are not distinguished from each other.

[Oxygen Value/BET Value 0.50 Mass %·$g/m^2$]

In analysis of oxygen and nitrogen contained in a powder, a finer powder having a larger specific surface area tends to exhibit a higher detected value due to the influence of a gas adhering to a surface. A powder having a smaller average particle diameter and a higher aspect ratio has a higher BET ($m^2/g$) value. Conversely, the substantial amount of oxygen contained in a powder having a higher BET ($m^2/g$) value can be considered to be smaller when the amounts of contained oxygen are equivalent to each other. Thus, the present inventors evaluated the ratio of oxygen value/BET value (hereinafter referred to as "oxygen value/BET value") in a powder having a small average particle diameter. As described in Examples, powders having low oxygen value/BET value, developed by the present inventors, also had high values of μ'. The small amount of contained oxygen can be considered to result in decrease in coercive force and in advantageousness in magnetic properties because of precluding an oxide pinning effect which inhibits grain growth in heat treatment, although the details are unclear. The reduction of the amount of contained oxygen was achieved by a device for suppressing oxidation as much as possible, as partly exemplified in the steps described above.

In the soft magnetic flattened powder of the present invention, a BET value and an oxygen value satisfy the conditions described above, and a value calculated by oxygen value/BET value is 0.50 mass %·$g/m^2$ or less, preferably 0.40 mass %~$g/m^2$ or less, and still more preferably 0.30 mass %·$g/m^2$ or less. However, since it is difficult to set the amount of oxygen contained in the powder at 0 mass % in view of production, the value of oxygen value/BET value excludes zero (i.e., the value is more than zero).

A surface-treated powder may be preferred from the viewpoint of, e.g., enhancing insulating properties after sheet molding. For the powder produced by the flattening-processing method of the present invention, a surface treatment step may be added as needed into a heat treatment step or before and after the heat treatment step. For example, the heat treatment may be performed under an atmosphere containing a minute amount of active gas, for the surface treatment.

Corrosion resistance and dispersibility in rubber can also be improved by surface treatment, typified by surface treatment with a conventionally proposed cyanide coupling agent. A method for producing a magnetic sheet is also enabled by a conventionally proposed method. For example, the production is enabled by dissolving chlorinated polyethylene or the like in toluene, mixing the solution with a flattened powder, applying and drying the mixture, and compressing the resultant by various presses or rollers.

EXAMPLES

The present invention will be specifically described below with reference to Examples.

[Production of Flattened Powder]

A powder with predetermined components was produced by a gas atomization method or a disk atomization method, and was classified into 150 μm or less. The gas atomization was performed by using a crucible made of alumina for melting, tapping a molten alloy metal from a nozzle having a diameter of 5 mm in the lower portion of the crucible, and spraying the molten alloy metal with a high-pressure argon gas. The powder as a raw powder was flattening-processed by an attritor. In the attritor, a ball of 4.8 mm in diameter made of SUJ2 was used and put together with the raw powder and industrial ethanol into a stirring vessel, and the processing was performed at a blade rotation number of 300 rpm. The amount of the added industrial ethanol was set at 200 to 500 parts by mass with respect to 100 parts by mass of the raw powder. A flattening auxiliary was not added or was set at 1 to 5 parts by mass with respect to 100 parts by mass of the raw powder. The flattened powder and industrial ethanol taken out from the stirring vessel after the flattening-processing were transferred to a dish made of stainless steel, and dried at 80° C. for 24 hours. The flattened powder obtained in such a manner was heat-treated in a vacuum or in an argon gas at 700 to 900° C. for 2 hours, and used for various evaluations.

[Evaluation of Flattened Powder]

The average particle diameter, true density, tap density, oxygen content, nitrogen content, and coercive forces of the obtained flattened powder were evaluated. The average particle diameter was evaluated by a laser diffraction method, and the true density was evaluated by a gas substitution method. The tap density was evaluated by a filling density measured after tapping 200 times at a drop height of 10 mm by filling about 20 g of the flattened powder into a cylinder having a capacity of 100 $cm^3$. For the coercive forces, the flattened powder was filled into a vessel made of resin of 6 mm in diameter and 8 mm in height, and values in the case of magnetization in the height direction of the vessel and in the case of magnetization in the diameter direction of the vessel were measured. Because the height direction of the filled column becomes the thickness direction of the flattened powder, the value in the case of the magnetization in the height direction of the vessel is the coercive force in the thickness direction of the flattened powder, and the value in the case of the magnetization in the diameter direction of the vessel is the coercive force in the longitudinal direction of the flattened powder. An applied magnetic field was 144 kA/m.

[Production and Evaluation of Magnetic Sheet]

Chlorinated polyethylene was dissolved in toluene, and the obtained flattened powder provided was mixed and dispersed in the solution. The dispersion liquid was applied to polyester resin to have a thickness of around 100 μm, and dried at normal temperature normal humidity. Then, the resultant was pressed at 130° C. and a pressure of 15 MPa to obtain a magnetic sheet. The magnetic sheet has a size measuring 150 mm per side and having a thickness of 50 μm. Each volume filling rate of the flattened powder in the magnetic sheet was about 50%. Then, the magnetic sheet was cuts into a doughnut shape having an outer diameter of 7 mm and an inner diameter of 3 mm, an impedance characteristic at 1 MHz was measured at room temperature by an impedance measurement instrument, and a magnetic permeability (real part of complex magnetic permeability: μ') was calculated from the result. Further, a cross section of the obtained magnetic sheet was filled with resin and polished, the longitudinal lengths and thicknesses of 50 powders were randomly measured based on the optical microscope image thereof, and the average of the ratios of the longitudinal lengths and thicknesses was regarded as an aspect ratio.

The present invention has been described above with reference to Examples. However, the present invention is not particularly limited to the Examples. Further, Comparative Examples were produced by changing, as appropriate, conditions shown in Table 1 described later. Evaluation results are shown in Table 1.

TABLE 1

| No. | Composition of Raw Powder (mass %) | Average Particle Diameter $D_{50}$ (μm) | Coercive force in Longitudinal Direction (A/m) | Ratio of Tap Density to True Density | BET Value ($m^2/g$) | Oxygen Content (mass %) | Oxygen Value/BET Value |
|---|---|---|---|---|---|---|---|
| 1 | Fe—9.5Si—5.5Al | 45 | 100 | 0.17 | 0.90 | 0.42 | 0.47 |
| 2 | Fe—9.5Si—5.5Al | 42 | 120 | 0.16 | 1.00 | 0.48 | 0.48 |
| 3 | Fe—8.0Si—7.0Al | 31 | 128 | 0.17 | 0.90 | 0.45 | 0.50 |
| 4 | Fe—8.0Si—7.0Al | 45 | 120 | 0.15 | 0.92 | 0.35 | 0.38 |
| 5 | Fe—8.0Si—7.0Al | 45 | 110 | 0.15 | 0.92 | 0.40 | 0.43 |
| 6 | Fe—9.0Si—6.0Al | 32 | 110 | 0.15 | 1.02 | 0.51 | 0.50 |
| 7 | Fe—9.0Si—6.0Al | 36 | 156 | 0.17 | 1.19 | 0.59 | 0.50 |
| 8 | Fe—9.0Si—6.0Al | 36 | 115 | 0.16 | 1.08 | 0.38 | 0.35 |
| 9 | Fe—9.0Si—6.0Al | 36 | 130 | 0.16 | 1.08 | 0.55 | 0.51 |
| 10 | Fe—9.0Si—6.0Al | 37 | 98 | 0.15 | 1.06 | 0.24 | 0.23 |
| 11 | Fe—9.0Si—6.0Al | 38 | 134 | 0.16 | 1.11 | 0.53 | 0.48 |
| 12 | Fe—9.0Si—6.0Al | 39 | 108 | 0.14 | 0.96 | 0.34 | 0.35 |
| 13 | Fe—9.0Si—6.0Al | 39 | 146 | 0.17 | 1.14 | 0.56 | 0.49 |
| 14 | Fe—9.0Si—6.0Al | 40 | 99 | 0.14 | 0.97 | 0.35 | 0.36 |
| 15 | Fe—9.0Si—6.0Al | 40 | 99 | 0.16 | 1.12 | 0.49 | 0.44 |
| 16 | Fe—9.0Si—6.0Al | 41 | 152 | 0.16 | 1.11 | 0.59 | 0.53 |
| 17 | Fe—9.0Si—6.0Al | 42 | 117 | 0.14 | 0.98 | 0.47 | 0.48 |
| 18 | Fe—9.0Si—6.0Al | 44 | 88 | 0.12 | 0.82 | 0.28 | 0.34 |
| 19 | Fe—9.0Si—6.0Al | 44 | 139 | 0.13 | 0.89 | 0.43 | 0.48 |
| 20 | Fe—9.0Si—6.0Al | 45 | 132 | 0.16 | 1.08 | 0.53 | 0.49 |
| 21 | Fe—9.0Si—6.0Al | 47 | 121 | 0.13 | 0.86 | 0.43 | 0.50 |
| 22 | Fe—9.0Si—6.0Al | 49 | 95 | 0.14 | 0.95 | 0.35 | 0.37 |

| No. | Method for Producing Raw Powder | Heat Treatment Temperature (° C.) | Heat Treatment Atmosphere | Coercive force in Thickness Direction (A/m) | Part of Complex Magnetic Permeability of Sheet | Remarks |
|---|---|---|---|---|---|---|
| 1 | GA | 800 | Ar | 240 | 158 | Present Invention Examples |
| 2 | GA | 800 | Ar | 320 | 161 | |
| 3 | GA | 850 | Vacuum | 310 | 152 | |
| 4 | GA | 700 | Vacuum | 240 | 160 | |
| 5 | DA | 740 | Vacuum | 230 | 156 | |
| 6 | GA | 800 | Vacuum | 272 | 150 | |
| 7 | GA | 800 | Vacuum | 368 | 152 | |
| 8 | GA | 800 | Vacuum | 288 | 163 | |
| 9 | GA | 800 | Vacuum | 304 | 151 | |
| 10 | GA | 800 | Vacuum | 288 | 174 | |
| 11 | GA | 800 | Vacuum | 312 | 155 | |
| 12 | GA | 800 | Vacuum | 264 | 163 | |

TABLE 1-continued

| | | | | | |
|---|---|---|---|---|---|
| 13 | GA | 800 | Vacuum | 288 | 158 |
| 14 | GA | 800 | Vacuum | 248 | 162 |
| 15 | GA | 800 | Vacuum | 264 | 154 |
| 16 | GA | 800 | Vacuum | 344 | 150 |
| 17 | GA | 900 | Vacuum | 280 | 152 |
| 18 | GA | 800 | Vacuum | 198 | 164 |
| 19 | GA | 800 | Vacuum | 280 | 150 |
| 20 | GA | 800 | Vacuum | 328 | 154 |
| 21 | GA | 800 | Vacuum | 272 | 161 |
| 22 | GA | 800 | Vacuum | 272 | 170 |

| No. | Composition of Raw Powder (mass %) | Average Particle Diameter $D_{50}$ (μm) | Flattened Power in Longitudinal Direction (A/m) | Ratio of Tap Density to True Density | BET Value ($m^2/g$) | Oxygen Content (mass %) | Oxygen Value/BET Value |
|---|---|---|---|---|---|---|---|
| 23 | Fe—9.5Si—5.5Al | 43 | 40 | 0.19 | 0.60 | 0.33 | 0.55 |
| 24 | Fe—9.5Si—5.5Al | 44 | 64 | 0.19 | 0.70 | 0.35 | 0.50 |
| 25 | Fe—9.5Si—5.5Al | 35 | 180 | 0.12 | 1.50 | 1.00 | 0.67 |
| 26 | Fe—8.0Si—7.0Al | 35 | 45 | 0.31 | 0.20 | 0.14 | 0.70 |
| 27 | Fe—8.0Si—7.0Al | 47 | 70 | 0.22 | 0.30 | 0.30 | 1.00 |
| 28 | Fe—8.0Si—7.0Al | 40 | 104 | 0.20 | 0.60 | 0.40 | 0.67 |
| 29 | Fe—8.0Si—7.0Al | 27 | 200 | 0.17 | 1.00 | 1.20 | 1.20 |
| 30 | Fe—8.5Si—6.0Al | 46 | 58 | 0.20 | 0.40 | 0.20 | 0.50 |
| 31 | Fe—8.5Si—6.0Al | 52 | 130 | 0.15 | 0.80 | 0.50 | 0.63 |
| 32 | Fe—8.5Si—6.0Al | 48 | 180 | 0.14 | 1.10 | 0.70 | 0.64 |
| 33 | Fe—8.5Si—6.0Al | 40 | 220 | 0.13 | 1.30 | 1.00 | 0.77 |
| 34 | Fe—8.0Si—7.0Al | 45 | 80 | 0.15 | 0.92 | 0.50 | 0.54 |
| 35 | Fe—8.0Si—7.0Al | 45 | 120 | 0.15 | 0.92 | 0.70 | 0.76 |
| 36 | Fe—8.0Si—7.0Al | 48 | 185 | 0.12 | 1.08 | 0.30 | 0.28 |
| 37 | Fe—8.0Si—7.0Al | 45 | 191 | 0.15 | 0.92 | 0.50 | 0.43 |
| 38 | Fe—8.0Si—7.0Al | 45 | 526 | 0.15 | 0.92 | 0.26 | 0.28 |

| No. | Method for Producing Raw Powder | Heat Treatment Temperature (° C.) | Heat Treatment Atmosphere | Flattened Power in Thickness Direction (A/m) | Part of Complex Magnetic Permeability of Sheet | Remarks |
|---|---|---|---|---|---|---|
| 23 | GA | 800 | Ar | 80 | 145 | Comparative Examples |
| 24 | GA | 800 | Ar | 150 | 147 | |
| 25 | GA | 800 | Atmospheric air | 420 | 120 | |
| 26 | GA | 800 | Vacuum | 80 | 115 | |
| 27 | GA | 800 | Vacuum | 152 | 125 | |
| 28 | GA | 800 | Vacuum | 200 | 135 | |
| 29 | GA | 800 | Vacuum | 350 | 110 | |
| 30 | GA | 800 | Ar | 139 | 125 | |
| 31 | GA | 800 | Ar | 245 | 140 | |
| 32 | GA | 950 | Ar | 310 | 130 | |
| 33 | WA | 800 | Ar | 352 | 110 | |
| 34 | GA | 800 | Vacuum | 200 | 140 | |
| 35 | GA | 800 | Vacuum | 250 | 135 | |
| 36 | GA | 650 | Vacuum | 374 | 130 | |
| 37 | GA | 800 | Nitrogen | 383 | 135 | |
| 38 | GA | No Heat Treatment | No Heat Treatment | 1024 | 43 | |

NOTE 1:
The underlined figures fall outside the scope of the present invention.
NOTE 2:
GA: gas atomization method,
DA: disk atomization method,
WA: water atomization method As shown in Table 1, Nos. 1 to 22 are present invention examples, while Nos. 23 to 38 are comparative examples.

Comparative Example Nos. 23 and 24 result in non-improvement in magnetic permeability values because the ratios of tap densities to true densities are high and flattening-processing does not proceed in comparison with the present invention examples. In addition, No. 23 results in non-improvement in magnetic permeability due to a high value of oxygen value/BET value and a high oxygen value with respect to a powder shape. Comparative Example No. 25 results in non-improvement in magnetic permeability value due to high oxygen value/BET value and high coercive forces because of being heat-treated in atmospheric air and having a high oxygen value in comparison with the present invention examples.

Comparative Example Nos. 26 to 28 exhibit the high ratios of tap densities to true densities in comparison with the present invention examples. In addition, Nos. 26 and 27 exhibit low BET values and low values of oxygen value/BET value. Therefore, magnetic permeability values are not improved. Comparative Example No. 29 exhibits a small average particle diameter in comparison with the present invention examples. Further, a magnetic permeability value is not improved due to a high oxygen value, a low value of oxygen value/BET value, and high coercive forces.

Comparative Example No. 30 results in non-improvement in magnetic permeability value due to the high ratio of a tap density to a true density and a low BET value in comparison with the present invention examples.

Comparative Example No. 31 results in non-improvement in magnetic permeability value due to a large average particle diameter and high oxygen value/BET value in comparison with the present invention examples. Comparative Example No. 32 exhibits a high heat treatment temperature, a high oxygen value, high oxygen value/BET value, and high coercive forces in comparison with the present invention examples. Therefore, magnetic permeability is not improved.

Comparative Example No. 33 is operated in water atomization in comparison with the present invention examples. Further, an oxygen value is high, oxygen value/BET value is high, and coercive forces are high. Therefore, a magnetic permeability is not improved. Comparative Example No. 34 results in non-improvement in magnetic permeability due to high oxygen value/BET value in comparison with the present invention examples. Comparative Example No. 35 results in non-improvement in magnetic permeability due to a high oxygen value and high oxygen value/BET value in comparison with the present invention examples.

Comparative Example No. 36 results in non-improvement in magnetic permeability due to a low heat treatment temperature and high coercive forces in comparison with the present invention examples. Comparative Example No. 37 is heat-treated in nitrogen, exhibits high coercive forces, and results in non-improvement in magnetic permeability in comparison with the present invention examples. Comparative Example No. 38 results in non-improvement in magnetic permeability because of not being subjected to a heat treatment step and of exhibiting high coercive forces in comparison with the present invention examples.

In contrast, all of the present invention Nos. 1 to 22 made it possible to produce a soft magnetic flattened powder having excellent sheet moldability and a high magnetic permeability because of satisfying the conditions of the present invention.

As described above, the very excellent effect of enabling production of a magnetic sheet for an electromagnetic wave absorber having a sufficiently high magnetic permeability is exhibited by using the soft magnetic flattened powder that satisfies the conditions according to the present invention.

The invention claimed is:

1. A soft magnetic flattened powder comprising an Fe—Si—Al-based alloy, an average particle diameter $D_{50}$ being 30 to less than 50 μm;

a coercive force Hc measured by applying a magnetic field in the longitudinal direction of the flattened powder being 176 A/m or less;

the ratio of a tap density to a true density being 0.18 or less;

a specific surface area BET value being 0.6 $m^2/g$ or more;

the amount of contained oxygen being 0.6 mass % or less; and the BET value and oxygen value of the soft magnetic powder satisfying the following expression (1):

$$\text{oxygen value/BET value} \leq 0.50 \text{ mass \%} \cdot g/m^2 \text{ (excluding zero)} \quad (1).$$

2. A method for producing a soft magnetic flattened powder according to claim 1, comprising:

a raw powder production step of producing a raw powder by a gas atomization method or a disk atomization method;

a flattening-processing step of flattening the raw powder; and a heat treatment step of heat-treating the flattening-processed raw powder in a vacuum or argon atmosphere at 700 to 900° C.

* * * * *